US006051084A

United States Patent [19]

Tetsui

[11] Patent Number: 6,051,084

[45] **Date of Patent: *Apr. 18, 2000**

[54] TIAL INTERMETALLIC COMPOUND-BASED ALLOYS AND METHODS FOR PREPARING SAME

[75] Inventor: Toshimitsu Tetsui, Yokohama, Japan

[73] Assignee: Mitsubishi Jukogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,594

[22] PCT Filed: Jul. 6, 1995

[86] PCT No.: PCT/JP95/01349

§ 371 Date: Mar. 26, 1996

§ 102(e) Date: Mar. 26, 1996

[87] PCT Pub. No.: WO96/12820

PCT Pub. Date: May 2, 1996

[30] Foreign Application Priority Data

Oct. 25, 1994 [JP] Japan ..... 6-283952
Jan. 19, 1995 [JP] Japan ..... 7-006262

[51] Int. Cl.[7] ..... C22C 14/00

[52] U.S. Cl. ..... 148/421; 420/418

[58] Field of Search ..... 148/538, 669–671, 148/407, 421; 420/418; C22C 14/00

[56] References Cited

U.S. PATENT DOCUMENTS

| | | | |
|---|---|---|---|
| 5,089,225 | 2/1992 | Huang | 148/421 |
| 5,213,635 | 5/1993 | Huang | 148/421 |
| 5,232,661 | 8/1993 | Matsuo et al. | 148/671 |
| 5,264,051 | 11/1993 | Huang | 148/421 |
| 5,284,620 | 2/1994 | Larsen | 148/421 |
| 5,370,839 | 12/1994 | Masahashi et al. | 148/671 |
| 5,417,781 | 5/1995 | McQuay et al. | 148/670 |
| 5,431,754 | 7/1995 | Fujiwara et al. | 148/421 |
| 5,558,729 | 9/1996 | Kim et al. | 148/670 |

FOREIGN PATENT DOCUMENTS

| | | |
|---|---|---|
| 0549181 | 6/1993 | European Pat. Off. . |
| 19 964 | 5/1955 | Germany . |
| 4219470 | 12/1993 | Germany . |
| 3-285051 | 12/1991 | Japan . |
| 5-78769 | 3/1993 | Japan . |
| 5-255783 | 10/1993 | Japan . |
| 5-255827 | 10/1993 | Japan . |
| 5-320791 | 12/1993 | Japan . |
| 6-116692 | 4/1994 | Japan . |
| 6-346173 | 12/1994 | Japan . |

*Primary Examiner*—Sikyin Ip
*Attorney, Agent, or Firm*—Jacobson, Price, Holman & Stern PLLC

[57] ABSTRACT

TiAl intermetallic compound-based alloys comprising Ti, Al, Nb and Cr and, if necessary, further comprising Ni and Co, which have excellent plastic workability, good resistance to oxidation at high temperatures, high strength or good creep resistance.

1 Claim, 3 Drawing Sheets

X 200

X1000

X1000

X 1000

X 200

X 200

X 50

TIAL INTERMETALLIC COMPOUND-BASED ALLOYS AND METHODS FOR PREPARING SAME

DESCRIPTION

1. Technical Field

First, this invention relates to TiAl intermetallic compound-based alloys having excellent plastic workability and good resistance to oxidation at high temperatures and hence suitable for use in power-generating gas turbines, aircraft engines and the like, as well as a method for preparing the same.

Secondly, this invention relates to TiAl intermetallic compound-based alloys having high strength and good resistance to oxidation at high temperatures and hence suitable for use in power-generating gas turbines, aircraft engines and the like, as well as a method for preparing the same.

Thirdly, this invention relates to TiAl intermetallic compound-based alloys having high strength, good creep resistance and good oxidation resistance and hence suitable for use in power-generating gas turbines, aircraft engines and the like.

2. Background Art (1) Background art concerning the first class of TiAl intermetallic compound-based alloys in accordance with the present invention and the method for preparing the same Alloys comprising the intermetallic compound TiAl as the primary phase have favorable characteristics in that they are lighter in weight and higher in strength than conventional Ti alloys and in that their oxidation resistance is good at temperatures up to about 700° C. Accordingly, it has been expected that they may be applicable to parts used in a high-temperature environment, such as turbine blades and turbine rotors. The aforesaid parts are of a complicated shape having three-dimensional curved surfaces, and one technique for creating such a product shape involves subjecting a material to plastic working (e.g., forging) using a die of the same profile.

TiAl intermetallic compound-based alloys are hard-to-work materials, and they must be heated to 1100° C. or above in order to work them plastically to product shapes without developing defects such as cracks and cavities. However, dies which can be used at 1100° C. or above on an industrial production level are not available in the present situation. Thus, their plastic working is difficult as a matter of fact and has not been put to practical use until now.

The composition of the TiAl intermetallic compound-based alloys which have hitherto been studied most closely is one having a slightly substoichiometric Al concentration of about 48 atomic percent and containing about 2 to 5 atomic percent of additional components, such as V, Mn, Cr and Nb, that may be used alone or in combination. The reason why the plastic workability of alloys of the aforesaid composition is insufficient is considered to be as follows:

In this composition, the generated phases are the TiAl phase (the $L1_0$ crystal structure; hereinafter referred to as the γ phase) and the $Ti_3Al$ phase (the $D0_{22}$ crystal structure; hereinafter referred to as the α2 phase) without regard to heat-treating conditions. Although its metallographic structure may vary slightly according to the heat-treating conditions, it is composed chiefly of coarse γ phase and a similarly coarse lamellar structure (i.e., a structure comprising alternate layers of the γ and α2 phases). The γ and α2 phases are both intermetallic compound phases and do not have sufficient plastic ductility even in a high-temperature region. Moreover, the lamellar structure is a highly anisotropic structure and, when the applied deformation stress is perpendicular to the direction of the lamellae, its deformation resistance is so high that little deformation is caused. Furthermore, since each crystal grain is large, boundary sliding and the like seldom occur.

Because of the above-described factors associated with material characteristics, TiAl intermetallic compound-based alloys of the prior art composition fail to sufficient plastic workability at 1100° C. or below. If it is tried to work them at 1100° C. or below, the material tends to develop defects such as cracks and cavities. Moreover, owing to the high deformation resistance of the material, the die becomes unable to retain its original shape and is hence deformed.

Furthermore, the oxidation resistance of alloys of the prior art composition is rapidly reduced above 800° C. Accordingly, when these alloys are applied to products, their service temperature is restricted.

(2) Background art concerning the second class of TiAl intermetallic compound-based alloys in accordance with the present invention and the method for preparing the same As described above, TiAl intermetallic compound-based alloys are expected to be applicable to parts used in a high-temperature environment, such as turbine blades and turbine rotors. These parts are parts where the principal stress comprises a centrifugal stress, i.e., parts which require high specific strength (strength normalized by specific gravity) as a material characteristic. In the present situation, these parts are made of superalloys. Accordingly, in order that a TiAl intermetallic compound-based alloy may be used as a substitute for superalloys, it is a prerequisite that the alloy should have a higher specific strength than superalloys. Moreover, since the alloy will be used in a high-temperature environment, it must have good oxidation resistance.

Since intermetallic compounds, not limited to TiAl intermetallic compounds, have poor cold ductility as compared with common metallic materials, previous investigations have been carried out with the main object of improving cold ductility. As described above, the composition of the TiAl intermetallic compound-based alloys which have hitherto been regarded as best is one having a slightly substoichiometric Al concentration of about 48 atomic percent and containing about 2 to 5 atomic percent of additional components, such as V, Mn, Cr and Nb, that may be used alone or in combination. As to structure, the so-called duplex structure which is formed by heat treatment at a temperature of around 1300° C. lying in the (α+γ) region and is composed of γ grains and lamellar grains (i.e., grains having a stratified structure comprising the γ and α2 phases) in a ratio of about 1:1 is considered to be best. However, the high-temperature strength of the aforesaid structure is low. For example, its strength at 800° C. is about 40 $Kgf/mm^2$. On the other hand, Inconel 713C, which is a typical superalloy, has a strength of about 90 $Kgf/mm^2$ at 800° C. Thus, although TiAl is light in weight (TiAl, specific gravity 3.8; Inconel 713C, specific gravity, 7.9), it is inferior to superalloys in specific strength. Accordingly, it may be said that the prior art TiAl alloys cannot be used as a substitute for superalloys.

In the prior art composition, structures other than the duplex structure may be formed. They include a structure which is formed by heat treatment at a temperature of 1200° C. or below lying in the γ region and composed largely of γ grains, and a structure which is formed by heat treatment at a temperature of about 1400° C. lying in the α region and composed entirely of coarse lamellar grains having a diameter of 1–3 mm. The high-oxidation strength of the former is lower than that of the duplex structure owing to the absence of lamellae. The latter has high hardness at high temperatures, but is brittle and liable to cleavage fracture. Thus, this structure is destroyed before exhibiting the strength inherently possessed thereby, and consequently has similarly low strength at high temperatures.

Furthermore, the oxidation resistance of alloys of the prior art composition is rapidly reduced above 800° C. Also from this point of view, their service temperature is restricted.

(3) Background art concerning the third class of TiAl intermetallic compound-based alloys in accordance with the present invention As described above, in order that a TiAl intermetallic compound-based alloy may be used as a substitute for superalloys, it is a prerequisite that the alloy should have a higher specific strength than superalloys. Moreover, since the alloy will be used in a high-temperature environment for a long period of time, it must have good creep resistance and good oxidation resistance.

Since intermetallic compounds, not limited to TiAl intermetallic compounds, have poor cold ductility as compared with common metallic materials, previous investigations have been carried out with the main object of improving cold ductility. As described above, the composition of the TiAl intermetallic compound-based alloys which have hitherto been regarded as best is one having a slightly substoichiometric Al concentration of about 48 atomic percent and containing about 2 to 5 atomic percent of additional components, such as V, Mn, Cr and Nb, that may be used alone or in combination.

The prior art alloys have a cold ductility of about 3% or greater and show a marked improvement. In this respect, they are considered to be almost satisfactory from a practical point of view. However, their high-temperature strength, creep resistance and oxidation resistance, which are characteristics required for use in turbine blades and turbine rotors, are still low as compared with superalloys. Accordingly, these alloys as such cannot be used as substitutes for superalloys. In this connection, more detailed data are given below.

High-temperature strength: The prior art TiAl alloys have a strength of about 40 Kgf/mm$^2$ at 800° C. On the other hand, Inconel 713C, which is a typical superalloy, has a strength of about 90 Kgf/mm$^2$ at 800° C. Thus, although TiAl is light in weight (TiAl, specific gravity 3.8; Inconel 713C, specific gravity, 7.9), it is inferior to superalloys in specific strength.

Creep resistance: When tested at 800° C. for 100 hours, the prior art TiAl alloys show a creep rupture strength of about 15 Kgf/mm$^2$. On the other hand, Inconel 713C show a strength of about 45 Kgf/mm$^2$ when tested under the same conditions. Thus, the prior art TiAl alloys are inferior to superalloys even when the creep resistance is expressed in terms of specific strength.

Oxidation resistance: When tested at 800° C. for 100 hours, the prior art TiAl alloys show an oxidation weight gain of about 10 mg/cm$^2$. On the other hand, Inconel 713C show an oxidation weight gain of about 2 mg/cm$^2$ when tested under the same conditions. Thus, the prior art TiAl alloys are markedly inferior in oxidation resistance.

Disclosure of the Invention (1) First class of TiAl intermetallic compound-based alloys and a method for preparing the same The present invention has been made in view of the above-described circumstances and a first object thereof is to provide TiAl intermetallic compound-based alloys having improved plastic workability and good resistance to oxidation at high temperatures, and a method for preparing the same.

The present inventor considered that a modification in phase composition and structure would be needed in order to improve the plastic workability of a TiAl intermetallic compound-based alloy, and intended to stabilize the β phase with his attention focused on the use of so-called β-stabilizing elements for Ti alloys (such as Nb, Cr, V, Mn and Mo) as additional components. Since the β phase is a solid solution of the b.c.c. structure or a B2 type intermetallic compound phase based on b.c.c., it can be expected that the β phase has good ductility in a high-temperature region and hence contributes to an improvement in plastic workability of the TiAl intermetallic compound-based alloy.

The present inventor prepared TiAl intermetallic compound-based alloys having various compositions containing the above-described additional components according to a process comprising melting, casting and heat-treating steps, and examined the relationship between composition and oxidation resistance or β phase stabilization, the relationship between composition or heat-treating conditions and structure, and the relationship between structure and plastic workability. As a result, the following findings (i) to (iii) have been obtained.

(i) Relationship between composition and oxidation resistance or β phase stabilization (a) The additional component which can improve the oxidation resistance of TiAl intermetallic compound-based alloys in the highest degree is Nb. From a compositional point of view, alloys having a Ti concentration of 40 to 50 atomic percent, an Al concentration of 42 to 50 atomic percent and a Nb concentration of 6 to 10 atomic percent have the best oxidation resistance. However, this composition fails to stabilize the β phase, and the generated phases are only the γ and α2 phases as observed in conventional TiAl intermetallic compound-based alloys.

(b) If 1.5 atomic percent or greater of a more powerful β-stabilizing element (such as Cr, Mo or V), together with 6 to 10 atomic percent of Nb, is added at an Al concentration of 47 atomic percent or less, the β phase is stabilized in addition to the γ and α2 phases. With additional components other than Cr, however, the oxidation resistance is reduced as compared with the alloys having only Nb added thereto.

(c) In order to achieve good oxidation resistance and stabilize the β phase, it is necessary to add a combination of 6 to 10 atomic percent of Nb and 1.5 atomic percent or more of Cr at a Ti concentration of 42 to 48 atomic percent and an Al concentration of 44 to 47 atomic percent.

(ii) Relationship between composition or heat-treating conditions and structure

With respect to alloys having good oxidation resistance and containing Nb and Cr to stabilize the β phase, the structures obtained in the as-cast state and after heat treatment at various temperatures were examined. As a result, it has been found that these structures can be roughly classified into the following three categories.

(a) Structure comprising an (α2+γ) lamellar structure and the γ and β phases

In a composition having a Ti concentration of 42 to 48 atomic percent, an Al concentration of 44 to 47 atomic percent, a Nb concentration of 6 to 10 atomic percent and a Cr concentration of 1.5 to 3.5 atomic percent, this structure is obtained in the as-cast state, after heat treatment at 1000 to 1130° C., and after heat treatment at 1230° C. or above.

(b) Structure having finely divided β phase dispersed in the γ phase

In the above-described composition, this structure is obtained after heat treatment at 1130 to 1230° C.

(c) Structure comprising coarse β phase and the γ phase

In a composition having a Ti concentration of 40 to 48 atomic percent, an Al concentration of 42 to 44 atomic percent, a Nb concentration of 6 to 10 atomic percent and a Cr concentration of 3 atomic percent or greater, this structure is obtained in the as-cast state and after heat treatment at 1000° C. or above. The proportion of the β phase is higher in the structure (c) than in the structure (b).

(iii) Relationship between structure and plastic workability

The plastic workability of the above-described structures (a) to (c) at a temperature of the order of 1025° C. which can be employed on an industrial production level is as follows:

The structure (a) containing lamellae has high deformation resistance and hence tends to develop defects such as cracks and cavities, as is the case with prior art alloys.

The structure (b) exhibits good plastic workability.

The structure (c) is superior to the structure (a), but inferior to the structure (b). This structure becomes more likely to develop defects as the working ratio is increased.

The first class of TiAl intermetallic compound-based alloys in accordance with the present invention have been developed on the basis of the above-described findings. Accordingly, it is an object of the present invention to provide a TiAl intermetallic compound-based alloy having excellent plastic workability and good resistance to oxidation at high temperatures, characterized in that the alloy has a Ti concentration of 42 to 48 atomic percent, an Al concentration of 44 to 47 atomic percent, a Nb concentration of 6 to 10 atomic percent and a Cr concentration of 1.5 to 3.5 atomic percent and in that finely-divided β phase is dispersed in the γ phase.

Moreover, it is another object of the present invention to provide a method for the preparation of a TiAl intermetallic compound-based alloy having excellent plastic workability and good resistance to oxidation at high temperatures, which comprises the steps of melting an alloy having a Ti concentration of 42 to 48 atomic percent, an Al concentration of 44 to 47 atomic percent, a Nb concentration of 6 to 10 atomic percent and a Cr concentration of 1.5 to 3.5 atomic percent, casting it, and then heat-treating it at a temperature in the range of 1130 to 1230° C.

(2) Second class of TiAl intermetallic compound-based alloys and a method for preparing the same The present invention has been made in view of the above-described circumstances and a second object thereof is to provide TiAl intermetallic compound-based alloys having improved high-temperature strength and good resistance to oxidation at high temperatures, and a method for preparing the same.

The present inventor considered that, in order to improve the high-temperature strength of a TiAl intermetallic compound-based alloy, its structure should be composed of fine lamellar grains having a diameter of 100 μm or less and this can be accomplished by dispersing a finely divided second phase between adjacent lamellar grains, and examined various additional components and heat-treating conditions. As a result, it has been recognized that, in contrast to prior art compositions, materials having a lower Al concentration of 44 to 47 atomic percent than in the prior art and additionally containing 1 to 3 atomic percent Cr have an (α+β) region in the temperature range of 1300 to 1400° C. and that the above-described structure can be realized by heat treatment in this region.

The second class of TiAl intermetallic compound-based alloys in accordance with the present invention have been developed on the basis of the above-described results of examination. Accordingly, it is an object of the present invention to provide a TiAl intermetallic compound-based alloy having high strength and good resistance to oxidation at high temperatures, characterized in that the alloy has a Ti concentration of 42 to 48 atomic percent, an Al concentration of 44 to 47 atomic percent, a Nb concentration of 6 to 10 atomic percent and a Cr concentration of 1 to 3 atomic percent and in that fine lamellar grains having a diameter of 100 μm or less are developed therein.

Moreover, it is another object of the present invention to provide a method for the preparation of a TiAl intermetallic compound-based alloy having high strength and good resistance to oxidation at high temperatures, which comprises the step of heat-treating an alloy having a Ti concentration of 42 to 48 atomic percent, an Al concentration of 44 to 47 atomic percent, a Nb concentration of 6 to 10 atomic percent and a Cr concentration of 1 to 3 atomic percent at a temperature in the range of 1300 to 1400° C.

(3) Third class of TiAl intermetallic compound-based alloys

The present invention has been made in view of the above-described circumstances and a third object thereof is to provide TiAl intermetallic compound-based alloys having high strength, good creep resistance and good oxidation resistance.

First of all, the present inventor examined various additional components from the viewpoint of oxidation resistance improvement and has recognized that the addition of Nb is effective. Moreover, it has been found that, in order to improve high-temperature strength while maintaining good cold ductility which is an excellent characteristic possessed by conventional alloys, the structure should be composed of fine lamellar grains having a diameter of 100 μm or less and this can be accomplished by dispersing a finely divided second phase (i.e., the β phase) between adjacent lamellar grains. That is, it has been found that oxidation resistance and high-temperature strength can be improved by adding Nb and Cr as additional components.

However, the creep resistance of the above-described alloy is better than that of prior art alloys, but poorer than that of Inconel 713C even when it is expressed in terms of specific strength. The reason for this was examined by observation of the structure obtained after creep deformation. Thus, it has been found that the deformation of the lamellar structure constituting the greater part of the alloy was slight while the deformation of the β phase present between lamellar grains was considerable. Moreover, it has also been found that the crystal structure of the β phase is the B2 structure based on the b.c.c. structure. It is known that an intermetallic compound of the B2 structure generally has high strength, but is low in long-time creep deformation resistance because the diffusion velocity of atoms therein is high owing to its crystal structure. That is, it has been found that, in the TiAl alloy having Nb and Co added thereto, the β phase constituting a second phase, though present in a slight amount, underwent creep deformation easily and hence prevented the creep strength of the whole alloy from being increased as had been expected.

On the basis of the above-described results of observation, the present inventor examined various fifth components in order to improve the creep resistance of the β phase and has found that the addition of Ni or Co, or both, is effective. Moreover, the reason for this was examined by observation of the structure. Thus, it has been found that, owing to the addition of Ni or Co, an intermetallic compound phase of the $L2_1$ structure (hereinafter referred to as the β' phase), which is analogous to the B2 structure and commonly known as the Heusler structure, is commensurately precipitated in the γ phase so as to have a grain size of the order of nanometers and, therefore, an interface just like the γ/γ' interface constituting a source of creep deformation resistance in Ni-based superalloys is formed in the β phase.

The third class of TiAl intermetallic compound-based alloys in accordance with the present invention have been developed on the basis of the above-described results of examination. Accordingly, it is an object of the present invention to provide a TiAl intermetallic compound-based alloy having high strength, good creep resistance and good oxidation resistance, characterized in that the alloy has a Ti concentration of 39 to 47 atomic percent, an Al concentration of 44 to 47 atomic percent, a Nb concentration of 6 to 10 atomic percent, a Cr concentration of 1 to 3 atomic percent and a (Ni+Co) concentration of 1 to 3 atomic percent.

Figure 1:
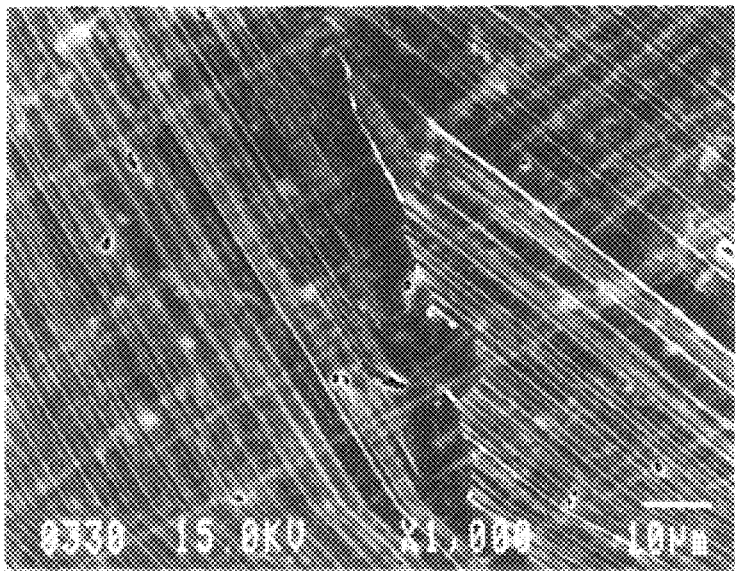
FIG. 1 is a photograph of a reflection electron image formed by a scanning electron microscope, showing the metallographic structure of the TiAl intermetallic compound-based alloy prepared in a comparative example (Example 1) related to the first alloy composition of the present invention.

BEST MODE FOR CARRYING OUT THE INVENTION (1) The functions and reasons for limitation of various components and the reasons for limitation of the heat-treating temperature in alloys (of the first alloy composition) in accordance with the present invention are described below.

(a) Ti

Ti is a principal constituent element of the alloys of the present invention. If the Ti concentration is less than 42 atomic percent, the β phase is not stabilized. Consequently, the alloy has a structure similar to that of prior art alloys, resulting in a reduction in plastic workability. On the other hand, if the Ti concentration is greater than 48 atomic percent, the proportion of coarse β phase is increased, resulting in a reduction in plastic workability.

(b) Al

Al is a principal constituent element of the alloys of the present invention. If the Al concentration is less than 44 atomic percent, the proportion of coarse β phase is increased, resulting in a reduction in plastic workability. On the other hand, if the Al concentration is greater than 47 atomic percent, the β phase is not stabilized. Consequently, the alloy has a structure similar to that of prior art alloys, resulting in a reduction in plastic workability.

(c) Nb

The primary function of Nb is to improve oxidation resistance, but Nb is somewhat effective in stabilizing the β phase. If the Nb concentration is less than 6 atomic percent, the effect of its addition is not recognized. On the other hand, if the Nb concentration is greater than 10 atomic percent, a reduction in oxidation resistance results.

(d) Cr

Cr has the function of stabilizing the β phase. If the Cr concentration is less than 1.5 atomic percent, the effect of its addition is not recognized. On the other hand, if the Cr concentration is greater than 3.5 atomic percent, the proportion of coarse β phase is increased, resulting in a reduction in plastic workability.

(e) Heat-treating temperature

For alloys in accordance with the present invention, heat treatment is carried out so as to eliminate the lamellar structure formed during casting and create a structure in which the generated phases are the γ and β phases and finely divided β phase is dispersed in the γ phase. If the heat-treating temperature is lower than 1130° C., the heat treatment fails to produce a sufficient effect, so that the remaining lamellar structure causes low plastic workability. On the other hand, if the heat-treating temperature is higher than 1230° C., a lamellar structure is newly formed by a phase transition, resulting in a reduction in plastic workability.

Now, examples related to the first alloy composition of the present invention are described hereinbelow.

Using 99.9% pure Ti, 99.99% pure Al, 99.9% pure Nb and 99.9% pure Cr as raw materials, ingots having the compositions shown in Table A were prepared in a non-consumable electrode type arc melting furnace. Then, either in the as-cast state or after being heat-treated at various temperatures in an atmosphere of Ar for 5 hours, these ingots were machined to prepare cylindrical specimens having a diameter of 12 mm and a height of 12 mm, and these specimens were subjected to a compression test. The test conditions included a test temperature of 1025° C. and a strain rate of $1\times10^{-3}$/s. The specimens were compressed to ¼ of the initial height, and their plastic workability was evaluated on the basis of the maximum stress and the presence or absence of the development of defects (such as cracks and cavities) in the cross-sectional structure. Moreover, oxidation test specimens comprising 15 mm×20 mm×2 mm flat plates were cut out, polished with emery paper up to No. 1000, and subjected to an oxidation test. Using a test temperature of 900° C., the specimens were allowed to stand in air for 100 hours and their oxidation resistance was evaluated on the basis of the resulting oxidation weight gain.

Examples 1–3 show the results obtained when a Ti-Al binary alloy having an Al concentration of 48 atomic percent was tested in the as-cast state or after heat treatment at 1200° C. or 1300° C. In all cases, the maximum stress during compression test was 190 MPa or greater and the development of defects was observed. Moreover, the oxidation weight gain was 25.1 mg/cm$^2$ or greater, indicating that its oxidation resistance was unsatisfactory.

Examples 4–6 show the results obtained when an alloy having an Al concentration of 48 atomic percent and additionally containing 3 atomic percent Cr was tested in the as-cast state or after heat treatment at 1200° C. or 1300° C. In all cases, the maximum stress during compression test was 170 MPa or greater and the development of defects was observed. Moreover, the oxidation weight gain was 24.1 mg/cm$^2$ or greater, indicating that its oxidation resistance was unsatisfactory.

Examples 7–12 relate to an alloy in accordance with the present invention and show the results obtained when an alloy comprising 42 atomic percent Ti, 47 atomic percent Al, 9 atomic percent Nb and 2 atomic percent Cr was tested in the as-cast state or after heat treatment at 1100° C., 1150° C., 1200° C., 1250° C. or 1350° C. After heat treatment at 1150° C. or 1200° C., the maximum stress was 140 MPa or less and no defects were developed. On the other hand, in the as-cast state and after heat treatment at 1100° C., 1250° C. or 1350° C., the maximum stress was 170 MPa or greater and the development of defects was observed. The oxidation weight gain was 3.5 mg/cm$^2$ or less, indicating that its oxidation resistance was markedly superior as compared with Examples 1–6.

Examples 13–18 relate to an alloy in accordance with the present invention and show the results obtained when an alloy comprising 45 atomic percent Ti, 45 atomic percent Al, 8 atomic percent Nb and 2 atomic percent Cr was tested in the as-cast state or after heat treatment at 1100° C., 1150° C., 1200° C., 1250° C. or 1350° C. After heat treatment at 1150° C. or 1200° C., the maximum stress was 120 MPa or less and no defects were developed. On the other hand, in the as-cast state and after heat treatment at 1100° C., 1250° C. or 1350° C., the maximum stress was 160 MPa or greater and the development of defects was observed. The oxidation weight gain was 3.3 mg/cm$^2$ or less, indicating that its oxidation resistance was markedly superior as compared with Examples 1–6.

Examples 19–24 relate to an alloy in accordance with the present invention and show the results obtained when an alloy comprising 48 atomic percent Ti, 44 atomic percent Al, 6 atomic percent Nb and 2 atomic percent Cr was tested in the as-cast state or after heat treatment at 1100° C., 1150° C., 1200° C., 1250° C. or 1350° C. After heat treatment at 1150° C. or 1200° C., the maximum stress was 120 MPa or less and no defects were developed. On the other hand, in the as-cast state and after heat treatment at 1100° C., 1250° C. or 1350° C., the maximum stress was 150 MPa or greater and the development of defects was observed. The oxidation weight gain was 4.6 mg/cm$^2$ or less, indicating that its oxidation resistance was markedly superior as compared with Examples 1–6.

Examples 25–30 relate to an alloy in accordance with the present invention and show the results obtained when an alloy comprising 45 atomic percent Ti, 45 atomic percent Al, 8.5 atomic percent Nb and 1.5 atomic percent Cr was tested in the as-cast state or after heat treatment at 1100° C., 1150° C., 1200° C., 1250° C. or 1350° C. After heat treatment at 1150° C. or 1200° C., the maximum stress was 120 MPa or less and no defects were developed. On the other hand, in the as-cast state and after heat treatment at 1100° C., 1250° C. or 1350° C., the maximum stress was 190 MPa or greater and the development of defects was observed. The oxidation weight gain was 3.5 mg/cm$^2$ or less, indicating that its oxidation resistance was markedly superior as compared with Examples 1–6.

Examples 31–36 relate to an alloy in accordance with the present invention and show the results obtained when an alloy comprising 45 atomic percent Ti, 45 atomic percent Al, 6.5 atomic percent Nb and 3.5 atomic percent Cr was tested in the as-cast state or after heat treatment at 1100° C., 1150° C., 1200° C., 1250° C. or 1350° C. After heat treatment at 1150° C. or 1200° C., the maximum stress was 140 MPa or less and no defects were developed. On the other hand, in the as-cast state and after heat treatment at 1100° C., 1250° C. or 1350° C., the maximum stress was 170 MPa or greater and the development of defects was observed. The oxidation weight gain was 4.3 mg/cm$^2$ or less, indicating that its oxidation resistance was markedly superior as compared with Examples 1–6.

Examples 37 and 38 show the test results of alloys having a Ti concentration outside the scope of the present invention. After heat treatment at 1200° C., the maximum stress was 180 MPa or greater and the development of defects was observed. However, the oxidation weight gain was 4.5 mg/cm$^2$ or less, indicating that their oxidation resistance was markedly superior as compared with Examples 1–6.

Examples 38 and 39 show the test results of alloys having an Al concentration outside the scope of the present invention. After heat treatment at 1200° C., the maximum stress was 180 MPa or greater and the development of defects was observed. However, the oxidation weight gain was 4.5 mg/cm$^2$ or less, indicating that their oxidation resistance was markedly superior as compared with Examples 1–6.

Examples 40 and 41 show the test results of alloys having a Nb concentration outside the scope of the present invention. After heat treatment at 1200° C., the maximum stress was 150 MPa or greater and the development of defects was observed. However, the oxidation weight gain was 7.1 mg/cm$^2$ or greater, indicating that their oxidation resistance was superior as compared with Examples 1–6, but inferior as compared with Examples 7–36.

Examples 42 and 43 show the test results of alloys having a Cr concentration outside the scope of the present invention. After heat treatment at 1200° C., the maximum stress was 180 MPa or greater and the development of defects was observed. However, the oxidation weight gain was 3.3 mg/cm$^2$ or less, indicating that their oxidation resistance was markedly superior as compared with Examples 1–6.

TABLE A

| Ex. | Composition (at. %) | | | | Heat-treating | Results of compression test | | Oxidation |
|---|---|---|---|---|---|---|---|---|
| | | | | | | Maximum stress | Development | weight gain |
| No. | Ti | Al | Nb | Cr | condition | (MPa) | of cracks | (mg/cm$^2$) |
| 1 | 52 | 48 | — | — | As cast | 200 | Yes | 25.1 |
| 2 | 52 | 48 | — | — | 1200° C. | 190 | | 26.2 |
| 3 | 52 | 48 | — | — | 1300° C. | 230 | | 27.0 |
| 4 | 49 | 48 | — | 3 | As cast | 180 | | 25.1 |
| 5 | 49 | 48 | — | 3 | 1200° C. | 170 | | 24.1 |
| 6 | 49 | 48 | — | 3 | 1300° C. | 200 | | 24.8 |
| 7 | 42 | 47 | 9 | 2 | As cast | 210 | Yes | 2.9 |

TABLE A-continued

| Ex. No. | Composition (at. %) Ti | Al | Nb | Cr | Heat-treating condition | Results of compression test: Maximum stress (MPa) | Develop-ment of cracks | Oxidation weight gain (mg/cm$^2$) |
|---|---|---|---|---|---|---|---|---|
| 8 | | | | | 1100° C. | 170 | | 2.2 |
| 9 | | | | | 1150° C. | 140 | No | 2.5 |
| 10 | | | | | 1200° C. | 130 | | 3.0 |
| 11 | | | | | 1250° C. | 180 | Yes | 3.1 |
| 12 | | | | | 1350° C. | 250 | | 3.5 |
| 13 | 45 | 45 | 8 | 2 | As cast | 220 | Yes | 3.2 |
| 14 | | | | | 1100° C. | 160 | | 3.1 |
| 15 | | | | | 1150° C. | 120 | No | 2.8 |
| 16 | | | | | 1200° C. | 110 | | 2.7 |
| 17 | | | | | 1250° C. | 170 | Yes | 3.2 |
| 18 | | | | | 1350° C. | 280 | | 3.3 |
| 19 | 48 | 44 | 6 | 2 | As cast | 200 | Yes | 3.8 |
| 20 | | | | | 1100° C. | 150 | | 4.1 |
| 21 | | | | | 1150° C. | 120 | No | 3.9 |
| 22 | | | | | 1200° C. | 100 | | 4.3 |
| 23 | | | | | 1250° C. | 150 | Yes | 4.2 |
| 24 | | | | | 1350° C. | 230 | | 4.6 |
| 25 | 45 | 45 | 8.5 | 1.5 | As cast | 250 | Yes | 2.9 |
| 26 | | | | | 1100° C. | 190 | | 2.7 |
| 27 | | | | | 1150° C. | 160 | No | 2.4 |
| 28 | | | | | 1200° C. | 150 | | 3.0 |
| 29 | | | | | 1250° C. | 200 | Yes | 3.2 |
| 30 | | | | | 1350° C. | 320 | | 3.5 |
| 31 | 45 | 45 | 6.5 | 3.5 | As cast | 230 | Yes | 3.5 |
| 32 | | | | | 1100° C. | 170 | | 4.1 |
| 33 | | | | | 1150° C. | 140 | No | 3.7 |
| 34 | | | | | 1200° C. | 120 | | 4.0 |
| 35 | | | | | 1250° C. | 170 | Yes | 3.9 |
| 36 | | | | | 1350° C. | 220 | | 4.3 |
| 37 | 41 | 41 | 10 | 2 | 1200° C. | 190 | Yes | 2.8 |
| 38 | 59 | 43 | 6 | 2 | | 180 | | 4.5 |
| 39 | 43 | 48 | 7 | 2 | | 200 | | 3.8 |
| 40 | 46 | 47 | 5 | 2 | | 150 | No | 7.1 |
| 41 | 43 | 44 | 11 | 2 | | 140 | | 7.6 |
| 42 | 45 | 46 | 8 | 1 | | 200 | Yes | 2.9 |
| 43 | 44 | 45 | 7 | 4 | | 180 | | 3.3 |

With regard to the alloys prepared in the foregoing Examples 1, 16 and 38, photographs of reflection electron images formed by a scanning electron microscope are given below.

FIG. 1 shows the reflection electron image formed by examining the as-cast Ti-Al binary alloy of Example 1 with a scanning electron microscope. In this figure, the black matrix comprises the γ phase and the gray phase comprises the α2 phase. It can be seen from this figure that the generated phases are the γ and α2 phases and the structure is a lamellar structure in which the γ and α2 phases are arranged in alternate layers and each lamellar grain has a large diameter.

Figure 2:
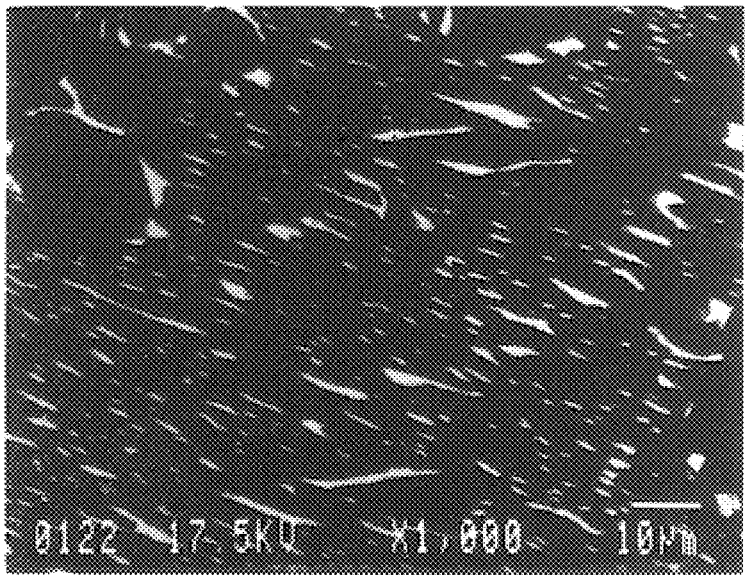
FIG. 2 is a photograph of a reflection electron image formed by a scanning electron microscope, showing the metallographic structure of the TiAl intermetallic compound-based alloy prepared in a working example (Example 16) related to the first alloy composition of the present invention.

FIG. 2 shows the reflection electron image formed by heat-treating the alloy of Example 16 within the scope of the present invention at 1200° C. and then examining it with a scanning electron microscope. In this figure, the black matrix comprises the γ phase and the white phase comprises the β phase. It can be seen from this figure that the generated phases are the γ and β phases and the structure is one in which finely divided β phase is dispersed.

Figure 3:
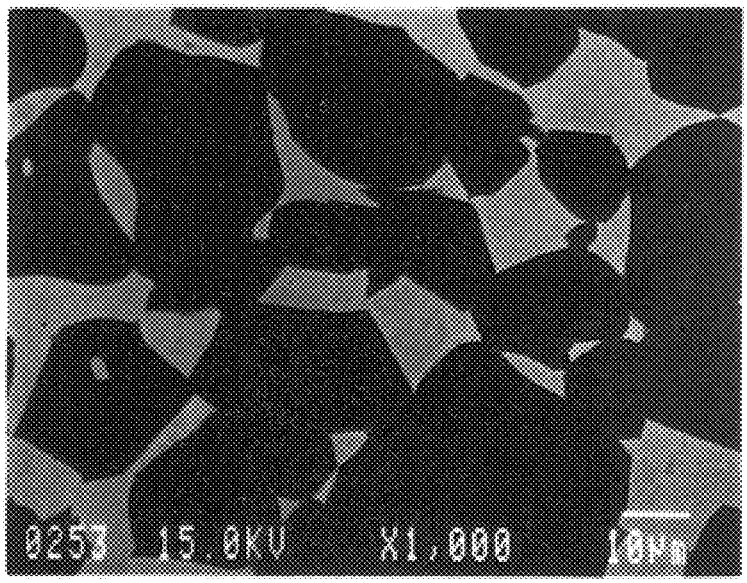
FIG. 3 is a photograph of a reflection electron image formed by a scanning electron microscope, showing the metallographic structure of the TiAl intermetallic compound-based alloy prepared in a comparative example (Example 38) related to the first alloy composition of the present invention.

FIG. 3 shows the reflection electron image formed by heat-treating the alloy of Example 38 having a lower Al concentration than the alloy of the present invention at 1200° C. and then examining it with a scanning electron microscope. In this figure, the black matrix comprises the γ phase and the white phase comprises the β phase. It can be seen from this figure that the generated phases are the γ and β phases and a high proportion of coarse β phase is present.

(2) The functions and reasons for limitation of various components and the reasons for limitation of the heat-treating temperature in alloys (of the second alloy composition) in accordance with the present invention are described below.

(a) Ti

Ti is a principal constituent element of the alloys of the present invention. If the Ti concentration is less than 42 atomic percent, the proportion of lamellar grains is decreased, resulting in a reduction in high-temperature strength. On the other hand, if the Ti concentration is greater than 48 atomic percent, the proportion of the second phase is excessively increased because the lamellar grains become finer. This causes a decrease of lamellar grains, resulting in a reduction high-temperature strength.

(b) Al

Al is a principal constituent element of the alloys of the present invention. If the Al concentration is less than 44 atomic percent, the proportion of the second phase is excessively increased because the lamellar grains become finer. This causes a decrease of lamellar grains, resulting in a reduction high-temperature strength. On the other hand, if the Al concentration is greater than 47 atomic percent, the proportion of lamellar grains is decreased as observed in prior art alloys, resulting in a reduction high-temperature strength.

(c) Nb

Nb is an additional component for the improvement of oxidation resistance. If the Nb concentration is less than 6 atomic percent, the effect of its addition is not recognized. On the other hand, if the Nb concentration is greater than 10 atomic percent, the addition of such an excessive amount conversely causes a reduction in oxidation resistance.

(d) Cr

Cr has the function of stabilizing the second phase and thus making the lamellar grains finer. If the Cr concentration is less than 1 atomic percent, the effect of its addition is not recognized. On the other hand, if the Cr concentration is greater than 3 atomic percent, the proportion of the second phase is excessively increased. This causes a decrease in the proportion of lamellar grains, resulting in a reduction high-temperature strength.

(e) Heat-treating temperature

For alloys in accordance with the present invention, heat treatment is carried out in the (α+β) region so as to develop a lamellar structure and, at the same time, reduce the diameters of lamellar grains to 100 μm or less while dispersing a finely divided second phase therebetween. If the heat-treating temperature is lower than 1300° C. and hence in the (α+β+γ) region, the proportion of γ grains is decreased and, the high-temperature strength is as low as that of prior art alloys. On the other hand, if the heat-treating temperature is higher than 1400° C. and hence in the single α region, the absence of a second phase creates a structure composed of coarse lamellar grains as observed when prior art alloys are heat-treated at a temperature higher than 1400° C. This produces a brittle alloy showing a reduction high-temperature strength.

Now, examples related to the second alloy composition of the present invention are described hereinbelow.

Using 99.8% pure Ti, 99.9% pure Al, Nb and Cr as raw materials, ingots having the compositions shown in Table B were prepared by high-frequency induction melting. After being heat-treated at 1200° C. for 3 hours, these ingots were freely forged at 1025° C. to ⅓ of the initial height, so that forged materials were obtained.

After being heat-treated at the various temperatures shown in Table B, these forged materials were machined to prepare round bar specimens having a parallel portion diameter of 5 mm and a gauge length of 22 mm, and these specimens were subjected to a tension test. The tension test temperature was 800° C. Moreover, oxidation test specimens comprising 15 mm×20 mm×2 mm flat plates were cut out, polished with emery paper up to No. 1000, and subjected to an oxidation test. Using a test temperature of 900° C., the specimens were allowed to stand in air for 100 hours and their oxidation resistance was evaluated on the basis of the resulting oxidation weight gain.

Examples 201–203 relate to a prior art alloy and show the results obtained when an alloy comprising 50 atomic percent Ti, 48 atomic percent Al and 2 atomic percent Cr was tested after heat treatment at 1200° C., 1300° C. or 1400° C. In all cases, the tensile strength was as low as 44 Kgf/mm$^2$ or less. Moreover, the oxidation weight gain was 23 mg/cm$^2$ or greater, indicating that its oxidation resistance was unsatisfactory.

Examples 204–207 relate to an alloy in accordance with the present invention and show the results obtained when an alloy comprising 42 atomic percent Ti, 47 atomic percent Al, 10 atomic percent Nb and 1 atomic percent Cr was tested after heat treatment at 1280° C., 1320° C., 1380° C. or 1420° C. After heat treatment at 1320° C. or 1380° C., the tensile strength was as high as 62 Kgf/mm$^2$ or greater. On the other hand, after heat treatment at 1280° C. or 1420° C., the tensile strength was 50 Kgf/mm$^2$ or less and lower than the values obtained after heat treatment at 1320° C. or 1380° C. The oxidation weight gain was 3.6 mg/cm$^2$ or less in all cases, indicating that its oxidation resistance was markedly superior as compared with the prior art alloy of Examples 201–203.

Examples 208–211 relate to an alloy in accordance with the present invention and show the results obtained when an alloy comprising 45 atomic percent Ti, 45 atomic percent Al, 8 atomic percent Nb and 2 atomic percent Cr was tested after heat treatment at 1280° C., 1320° C., 1380° C. or 1420° C. After heat treatment at 1320° C. or 1380° C., the tensile strength was as high as 65 Kgf/mm$^2$ or greater. On the other hand, after heat treatment at 1280° C. or 1420° C., the tensile strength was 52 Kgf/mm$^2$ or less and lower than the values obtained after heat treatment at 320° C. or 1380° C. The oxidation weight gain was 2.8 mg/cm$^2$ or less in all cases, indicating that its oxidation resistance was markedly superior as compared with the prior art alloy.

Examples 212–215 relate to an alloy in accordance with the present invention and show the results obtained when an alloy comprising 48 atomic percent Ti, 44 atomic percent Al, 6 atomic percent Nb and 2 atomic percent Cr was tested after heat treatment at 1280° C., 1320° C., 1380° C. or 1420° C. After heat treatment at 1320° C. or 1380° C., the tensile strength was as high as 59 Kgf/mm$^2$ or greater. On the other hand, after heat treatment at 1280° C. or 1420° C., the tensile strength was 46 Kgf/mm$^2$ or less and lower than the values obtained after heat treatment at 1320° C. or 1380° C. The oxidation weight gain was 3.6 mg/cm$^2$ or less in all cases, indicating that its oxidation resistance was markedly superior as compared with the prior art alloy.

Examples 216–219 relate to an alloy in accordance with the present invention and show the results obtained when an alloy comprising 45 atomic percent Ti, 45 atomic percent Al, 7 atomic percent Nb and 3 atomic percent Cr was tested after heat treatment at 1280° C., 1320° C., 1380° C. or 1420° C. After heat treatment at 1320° C. or 1380° C., the tensile strength was as high as 58 Kgf/mm$^2$ or greater. On the other hand, after heat treatment at 1280° C. or 1420° C., the tensile strength was 48 Kgf/mm$^2$ or less and lower than the values obtained after heat treatment at 1320° C. or 1380° C. The oxidation weight gain was 3.1 mg/cm$^2$ or less in all cases, indicating that its oxidation resistance was markedly superior as compared with the prior art alloy.

Examples 220 and 221 show the test results of alloys having a Ti concentration outside the scope of the present invention. After heat treatment at 1380° C., the tensile strength was as low as 53 Kgf/mm$^2$ or less. However, the oxidation weight gain was 3.5 mg/cm$^2$ or less, indicating that their oxidation resistance was markedly superior as compared with the prior art alloy.

Examples 222 and 223 show the test results of alloys having an Al concentration outside the scope of the present invention. After heat treatment at 1380° C., the tensile strength was as low as 51 Kgf/mm$^2$ or less. However, the oxidation weight gain was 3.0 mg/cm$^2$ or less, indicating that their oxidation resistance was markedly superior as compared with the prior art alloy.

Examples 224 and 225 show the test results of alloys having a Nb concentration outside the scope of the present invention. After heat treatment at 1380° C., the tensile strength was as high as 59 Kgf/mm$^2$ or greater. However, the oxidation weight gain was 6.9 mg/cm$^2$ or greater, indicating that their oxidation resistance was inferior as compared with the alloys of the present invention.

Examples 226 and 227 show the test results of alloys having a Cr concentration outside the scope of the present invention. After heat treatment at 1380° C., the tensile strength was as low as 53 Kgf/mm$^2$ or less. However, the oxidation weight gain was 2.5 mg/cm$^2$ or less, indicating that their oxidation resistance was markedly superior as compared with the prior art alloy.

TABLE B

| Ex. | Composition (at. %) | | | | Heat-treating temperature | Tensile strength | Oxidation weight gain |
|---|---|---|---|---|---|---|---|
| No. | Ti | Al | Nb | Cr | (° C.) | (kgf/mm$^2$) | (mg/cm$^2$) |
| 201 | 50 | 48 | — | 2 | 1200 | 35.2 | 24.3 |
| 202 | | | | | 1300 | 41.3 | 26.5 |
| 203 | | | | | 1400 | 43.7 | 23.4 |
| 204 | 42 | 47 | 10 | 1 | 1280 | 43.2 | 3.2 |
| 205 | | | | | 1320 | 62.3 | 3.3 |
| 206 | | | | | 1380 | 65.7 | 3.6 |
| 207 | | | | | 1420 | 49.3 | 3.1 |
| 208 | 45 | 45 | 8 | 2 | 1280 | 47.5 | 2.4 |
| 209 | | | | | 1320 | 65.6 | 2.7 |
| 210 | | | | | 1380 | 67.5 | 2.8 |
| 211 | | | | | 1420 | 51.8 | 2.2 |
| 212 | 48 | 44 | 6 | 2 | 1280 | 42.9 | 3.5 |
| 213 | | | | | 1320 | 60.2 | 3.6 |
| 214 | | | | | 1380 | 59.3 | 3.1 |
| 215 | | | | | 1420 | 45.5 | 3.6 |
| 216 | 45 | 45 | 7 | 3 | 1280 | 43.6 | 2.8 |
| 217 | | | | | 1320 | 58.3 | 3.0 |
| 218 | | | | | 1380 | 60.2 | 2.7 |
| 219 | | | | | 1420 | 47.3 | 3.1 |
| 220 | 41 | 47 | 10 | 2 | 1380 | 49.5 | 3.5 |
| 221 | 49 | 44 | 6 | 1 | | 52.7 | 3.4 |
| 222 | 47 | 43 | 8 | 2 | | 50.9 | 2.6 |
| 223 | 43 | 48 | 7 | 2 | | 48.0 | 2.9 |
| 224 | 47 | 46 | 5 | 2 | | 59.6 | 7.1 |
| 225 | 43 | 44 | 11 | 2 | | 61.4 | 6.9 |

TABLE B-continued

| Ex. No. | Composition (at. %) Ti | Al | Nb | Cr | Heat-treating temperature (° C.) | Tensile strength (kgf/mm²) | Oxidation weight gain (mg/cm²) |
|---|---|---|---|---|---|---|---|
| 226 | 45 | 46 | 8.5 | 0.5 | | 52.3 | 2.3 |
| 227 | 44 | 45 | 7.5 | 3.5 | | 51.1 | 2.5 |

In order to show the differences in metallographic structure which are observed when an alloy is heat-treated in different phase regions, optical photomicrographs are given below.

Figure 4:
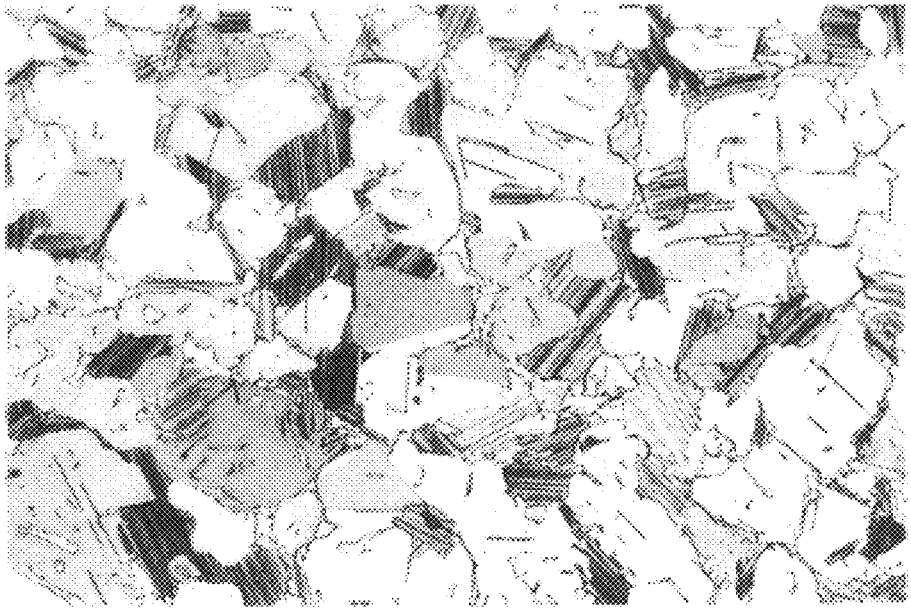
FIG. 4 is an optical photomicrograph showing the metallographic structure of the TiAl intermetallic compound-based alloy prepared in a comparative example (Example 208) related to the second alloy composition of the present invention.

FIG. 4 shows the metallographic structure of the alloy of Example 208 which was observed when an alloy comprising 45 atomic percent Ti, 45 atomic percent Al, 8 atomic percent Nb and 2 atomic percent Cr was heat-treated at a temperature of 1280° C. lying in the (α+β+γ) region. The term "lamellar" means a structure looking stratified and it can be seen that, in this case, the proportion of lamellar grains is as small as one half or less.

Figure 5:
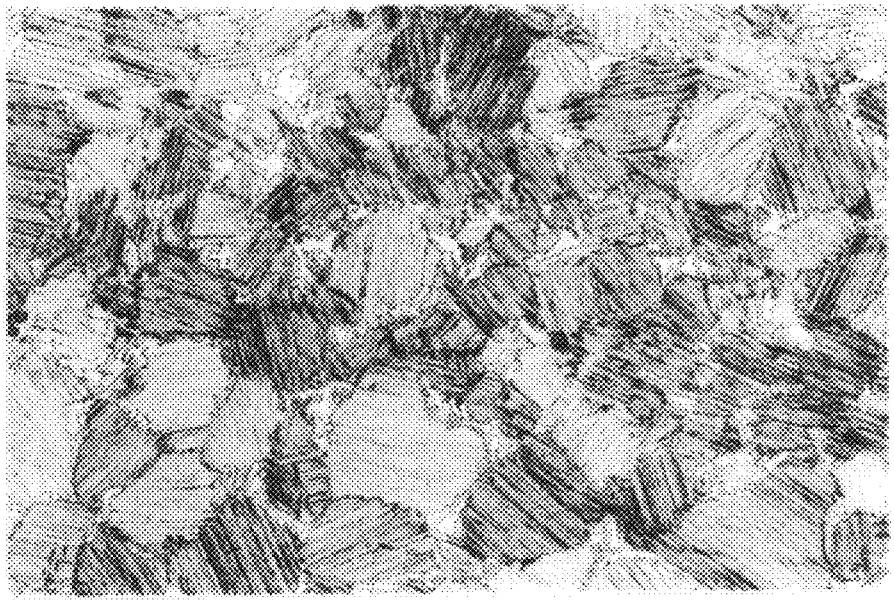
FIG. 5 is an optical photomicrograph showing the metallographic structure of the TiAl intermetallic compound-based alloy prepared in a working example (Example 210) related to the second alloy composition of the present invention.

FIG. 5 shows the metallographic structure of the alloy of Example 210 which was observed when an alloy having the same composition as that shown in FIG. 4 was heat-treated at a temperature of 1380° C. lying in the (α+β) region. It can be seen that most of the visual field is occupied by lamellar grains and a finely divided second phase is present between adjacent lamellar grains. It can also be seen that the lamellar grains have a very small diameter of about 50 μm.

Figure 6:
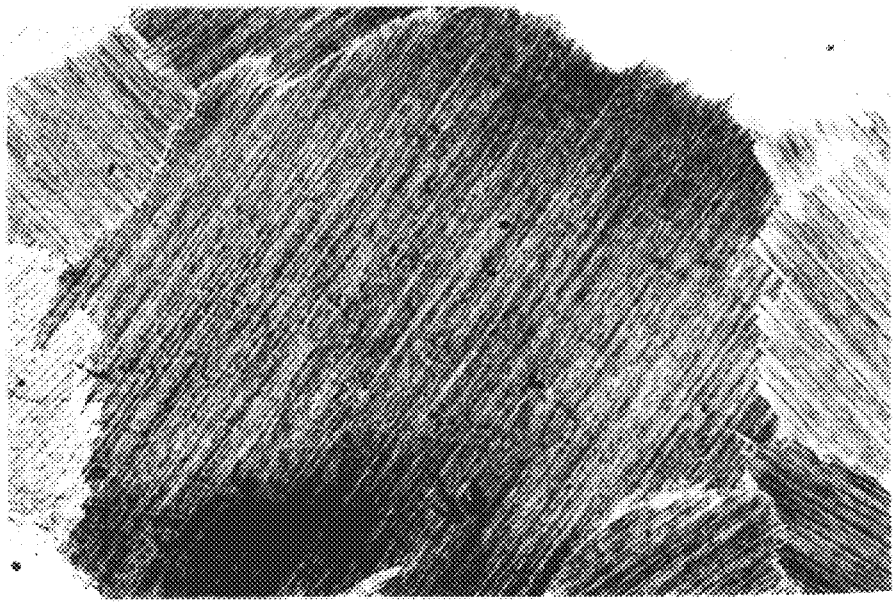
FIG. 6 is an optical photomicrograph showing the metallographic structure of the TiAl intermetallic compound-based alloy prepared in a comparative example (Example 211) related to the second alloy composition of the present invention.

FIG. 6 shows the metallographic structure of the alloy of Example 211 which was observed when an alloy having the same composition as that shown in FIG. 4 was heat-treated at a temperature of 1420° C. lying in the α region. It can be seen that the whole visual field is composed entirely of coarse lamellar grains having a diameter of the order of 2 mm.

(3) The functions and reasons for limitation of various components in alloys of the third alloy composition in accordance with the present invention are described below.

(a) Ti: Ti is a principal constituent element of these alloys. If the Ti concentration is less than 39 atomic percent, γ grains having low strength are produced and the structure becomes analogous to that of prior art alloys, resulting in a reduction in high-temperature strength and creep resistance. On the other hand, if the Ti concentration is greater than 47 atomic percent, the β phase is excessively increased and the lamellar grains are excessively decreased. This causes an improper component proportion in the structure, resulting in a reduction in high-temperature strength and creep resistance.

(b) Al: Al is a principal constituent element of these alloys. If the Al concentration is less than 44 atomic percent, the β phase is excessively increased and the lamellar grains are excessively decreased. This undesirably causes an improper component proportion in the structure. On the other hand, if the Al concentration is greater than 47 atomic percent, γ grains having low strength are produced and the structure undesirably becomes analogous to that of prior art alloys.

(c) Nb: Nb is an additional component for the improvement of oxidation resistance. If the Nb concentration is less than 6 atomic percent, the effect of its addition is not recognized. On the other hand, if the Nb concentration is greater than 10 atomic percent, the addition of such an excessive amount conversely causes a reduction in oxidation resistance.

(d) Cr: Cr has the function of stabilizing the β phase constituting a second phase and thus making the lamellar grains finer. If the Cr concentration is less than 1 atomic percent, the effect of its addition is not recognized. On the other hand, if the Cr concentration is greater than 3 atomic percent, the β phase is excessively increased and the lamellar grains are excessively decreased. This undesirably causes an improper component proportion in the structure.

(e) Ni and Co: Ni and Co have the same effect and function to stabilize the β' phase and precipitate it commensurately from the β phase. If the (Ni+Co) concentration is less than 1 atomic percent, the effect of their addition is not recognized. On the other hand, if the (Ni+Co) concentration is greater than 3 atomic percent, the β' phase is excessively increased and grown. This undesirably causes a decrease of the β/β' interface and hence a reduction in creep resistance.

Now, examples related to the third alloy composition of the present invention are described hereinbelow.

Using 99.8% pure Ti, 99.9% pure Al, Nb, Cr, Ni and Co as raw materials, ingots having the compositions shown in Table C were prepared by high-frequency induction melting. After being subjected to a homogenization treatment at 1000° C. for 50 hours, these ingots were machined to prepare tension specimens having a parallel portion diameter of 5 mm and a gauge length of 22 mm, as well as creep rupture test specimens. Moreover, oxidation test specimens measuring 20 mm×20 mm×2 mm were prepared.

High-temperature strength was evaluated on the basis of tensile strength. The test temperature was 800° C. and the initial strain rate was $3.8\times10^{-4}$/s. Creep resistance was evaluated on the basis of the rupture time observed in a creep rupture test. The test temperature was 800° C. and the load stress was 20 Kgf/mm². Oxidation resistance was evaluated on the basis of oxidation weight gain. The test temperature was 800° C. and the test time was 500 hours. All of these tests were carried out in air.

TABLE C

| Ex. No. | Composition (at. %) Ti | Al | Nb | Cr | Ni | Co | Tensile strength (kgf/mm²) | Creep rupture time (h) | Oxidation weight gain (mg/cm²) |
|---|---|---|---|---|---|---|---|---|---|
| 301 | 50 | 48 | 2 | — | — | — | 39.2 | 63 | 9.0 |
| 302 | 50 | 48 | — | 2 | — | — | 37.6 | 52 | 12.3 |
| 303 | 39 | 47 | 9 | 2 | 2 | 1 | 48.5 | 580 | 1.8 |
| 304 | 42 | 46 | 8 | 2 | 1 | 1 | 50.4 | 530 | 1.9 |
| 305 | 44 | 46 | 6 | 2 | 1 | 1 | 49.3 | 496 | 2.4 |
| 306 | 44 | 44 | 8 | 2 | 1 | 1 | 53.2 | 487 | 2.1 |
| 307 | 42 | 45 | 9 | 2 | 1 | 1 | 54.4 | 521 | 2.2 |
| 308 | 41 | 47 | 8 | 2 | 1 | 1 | 49.6 | 502 | 1.9 |
| 309 | 44 | 46 | 6 | 2 | 1 | 1 | 52.7 | 526 | 2.5 |
| 310 | 40 | 46 | 10 | 2 | 1 | 1 | 53.7 | 550 | 2.8 |
| 311 | 44 | 45 | 8 | 1 | 1 | 1 | 54.4 | 491 | 1.9 |
| 312 | 42 | 45 | 8 | 3 | 1 | 1 | 49.6 | 446 | 2.7 |
| 313 | 44 | 45 | 8 | 2 | 1 | — | 53.3 | 464 | 1.9 |
| 314 | 43 | 45 | 8 | 2 | 2 | — | 53.7 | 530 | 2.1 |
| 315 | 42 | 45 | 8 | 2 | 2 | 1 | 15.2 | 562 | 2.4 |
| 316 | 42 | 45 | 8 | 2 | 3 | — | 56.5 | 544 | 2.2 |
| 317 | 44 | 45 | 8 | 2 | — | 1 | 54.6 | 460 | 2.4 |
| 318 | 43 | 45 | 8 | 2 | — | 2 | 53.5 | 506 | 2.1 |
| 319 | 42 | 45 | 8 | 2 | 1 | 2 | 55.7 | 510 | 2.5 |
| 320 | 42 | 45 | 8 | 2 | — | 3 | 54.8 | 539 | 1.9 |
| 321 | 38 | 47 | 9 | 3 | 2 | 1 | 42.3 | 389 | 2.8 |
| 322 | 48 | 44 | 6 | 1 | — | 1 | 43.5 | 377 | 2.7 |
| 323 | 45 | 43 | 8 | 2 | 1 | 1 | 39.6 | 269 | 1.9 |
| 324 | 40 | 48 | 8 | 2 | 1 | 1 | 43.3 | 343 | 2.0 |
| 325 | 45 | 46 | 5 | 2 | 1 | 1 | 50.9 | 454 | 4.5 |
| 326 | 41 | 44 | 11 | 2 | 1 | 1 | 53.4 | 532 | 4.8 |
| 327 | 45 | 45 | 8 | — | 1 | 1 | 44.5 | 245 | 1.7 |
| 328 | 41 | 45 | 8 | 4 | 1 | 1 | 38.6 | 167 | 2.5 |

TABLE C-continued

| Ex. No. | Composition (at. %) Ti | Al | Nb | Cr | Ni | Co | Tensile strength (kgf/mm$^2$) | Creep rupture time (h) | Oxidation weight gain (mg/cm$^2$) |
|---|---|---|---|---|---|---|---|---|---|
| 329 | 45 | 45 | 8 | 2 | — | — | 52.3 | 145 | 2.1 |
| 330 | 42 | 44 | 8 | 2 | — | 4 | 50.4 | 345 | 2.4 |
| 331 | 42 | 44 | 8 | 2 | 2 | 2 | 51.6 | 267 | 2.5 |
| 332 | 42 | 44 | 8 | 2 | 4 | — | 54.3 | 288 | 2.1 |

Examples 301 and 302 relate to prior art alloys and show the results obtained by testing alloys containing 2 atomic percent of Nb or Cr at an Al concentration of 48 atomic percent. The tensile strength was of the order of 38 Kgf/mm$^2$, the creep rupture time was of the order of 60 hours, and the oxidation weight gain was of the order of 10 mg/cm$^2$.

Examples 303 to 320 relate to alloys in accordance with the present invention. The tensile strength was of 48 Kgf/mm$^2$ or greater, the creep rupture time was 445 hours or more, and the oxidation weight gain was 3.0 mg/cm$^2$ or less. These alloys were superior to the prior art alloys in all characteristics.

Examples 321 and 322 show the results obtained by testing alloys having a Ti concentration outside the scope of the present invention. The tensile strength and the creep rupture time were better as compared with the prior art alloys, but inferior as compared with the alloys of the present invention. The oxidation weight gain was substantially equal to those observed with the alloys of the present invention.

Examples 323 and 324 show the results obtained by testing alloys having an Al concentration outside the scope of the present invention. The tensile strength and the creep rupture time were better as compared with the prior art alloys, but inferior as compared with the alloys of the present invention. The oxidation weight gain was substantially equal to those observed with the alloys of the present invention.

Examples 325 and 326 show the results obtained by testing alloys having a Nb concentration outside the scope of the present invention. The tensile strength and the creep rupture time were substantially equal to those observed with the alloys of the present invention. The oxidation weight gain was better as compared with the prior art alloys, but inferior as compared with the alloys of the present invention.

Examples 327 and 328 show the results obtained by testing alloys having a Cr concentration outside the scope of the present invention. The tensile strength and the creep rupture time were better as compared with the prior art alloys, but inferior as compared with the alloys of the present invention. The oxidation weight gain was substantially equal to those observed with the alloys of the present invention.

Examples 329 to 332 show the results obtained by testing alloys having a (Ni+Co) concentration outside the scope of the present invention. The tensile strength and the creep rupture time were substantially equal to those observed with the alloys of the present invention. The oxidation weight gain was better as compared with the prior art alloys, but inferior as compared with the alloys of the present invention.

Industrial Applicability (1) As described above in detail, the first alloy composition of the present invention can provide TiAl intermetallic compound-based alloys having high strength and good resistance to oxidation at high temperatures and hence suitable for use in parts (such as turbine blades and turbine rotors) where the principal stress comprises a centrifugal stress in a high-temperature environment, i.e., parts which require high specific strength (strength normalized by specific gravity) as a material characteristic.

(2) As described above in detail, the second alloy composition of the present invention can provide TiAl intermetallic compound-based alloys having excellent plastic workability and good resistance to oxidation at high temperatures and hence suitable for use in products (such as turbine blades) which are formed into product shapes by plastic working.

(3) As described above in detail, the third alloy composition of the present invention can provide TiAl intermetallic compound-based alloys having high strength, good creep resistance and good oxidation resistance and hence suitable for use in parts which are used in a high-temperature environment for a long period of time and where the principal stress comprises a centrifugal stress, i.e., parts which require high strength at high temperatures, good creep resistance (as expressed in terms of specific strength) and good oxidation resistance as material characteristics.

I claim:

1. A TiAl intermetallic compound-based alloy consisting essentially of a Ti concentration of 39 to 47 atomic percent, an Al concentration of 44 to 47 atomic percent, a Nb concentration of 6 to 10 atomic percent, a Cr concentration of 1 to 3 atomic percent, and an additional material having a concentration of 1 to 3 atomic percent, the additional material being one of Nickel (Ni), Cobalt (Co) and (Ni+Co).

* * * * *